US008376532B2

(12) United States Patent
Kobayashi et al.

(10) Patent No.: US 8,376,532 B2
(45) Date of Patent: Feb. 19, 2013

(54) BULK INK SUPPLY SYSTEM

(75) Inventors: Kazutaka Kobayashi, Tomi (JP); Masaru Ohnishi, Tomi (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 112 days.

(21) Appl. No.: 13/069,413

(22) Filed: Mar. 23, 2011

(65) Prior Publication Data

US 2011/0221836 A1 Sep. 15, 2011

Related U.S. Application Data

(63) Continuation of application No. PCT/JP2009/050311, filed on Jan. 13, 2009.

(51) Int. Cl.
*B41J 2/175* (2006.01)

(52) U.S. Cl. ..... 347/85

(58) Field of Classification Search ..... 347/86
See application file for complete search history.

(56) References Cited

U.S. PATENT DOCUMENTS

| | | | | |
|---|---|---|---|---|
| 6,935,730 | B2 * | 8/2005 | Qingguo et al. | 347/86 |
| 7,029,103 | B2 * | 4/2006 | Iida | 347/86 |
| 2005/0146577 | A1 * | 7/2005 | Sasaki et al. | 347/86 |
| 2007/0070140 | A1 * | 3/2007 | Hattori et al. | 347/86 |
| 2007/0176987 | A1 * | 8/2007 | Tanahashi et al. | 347/86 |
| 2008/0158315 | A1 * | 7/2008 | Kawamura | 347/86 |
| 2008/0211890 | A1 * | 9/2008 | Kimura et al. | 347/86 |

FOREIGN PATENT DOCUMENTS

| | | | |
|---|---|---|---|
| JP | WO 03/076194 | | 9/2003 |
| JP | 2005-41083 | | 2/2005 |
| JP | 2005-041083 | * | 2/2005 |
| JP | 2005-518974 | | 6/2005 |
| JP | 2007-175998 | | 7/2007 |

OTHER PUBLICATIONS

International Search Report for corresponding International Application No. PCT/JP2009/050311, Feb. 10, 2009.

* cited by examiner

*Primary Examiner* — Matthew Luu
*Assistant Examiner* — Michael Konczal
(74) *Attorney, Agent, or Firm* — Ditthavong Mori & Steiner, P.C.

(57) ABSTRACT

A bulk ink supply system of an inkjet printer includes a connector, an ink flow path, and an on-off valve. The connector is attachable to and detachable from an ink container. The connector includes an ink guiding path formed in the connector. The ink flow path connects the ink guiding path and an inkjet head of the inkjet printer to supply an ink from the ink guiding path to the inkjet head. The on-off valve allows communication between the ink guiding path and the ink flow path when the ink container is attached to the connector and hinders communication between the ink guiding path and the ink flow path when the ink container is detached from the connector.

1 Claim, 9 Drawing Sheets

BULK INK SUPPLY SYSTEM

CROSS-REFERENCE TO RELATED APPLICATIONS

The present application is a continuation application of International Application No. PCT/JP2009/050311, filed Jan. 13, 2009. The contents of this application are incorporated herein by reference in their entirety.

BACKGROUND OF THE INVENTION

1. Field of the Invention

The present invention relates to a bulk ink supply system.

2. Discussion of the Background

A bulk ink supply system has been known as an ink supply means for an inkjet printer. See, for example, Japanese Unexamined Patent Application Publication (Translation of PCT Application) No. 2005-518974. In this bulk ink supply system, a dummy cartridge is attached to a cartridge attaching port of the inkjet printer, and an ink pack containing ink of an amount as much as 1 liter or 2 liters is attached to an ink pack pedestal located at a position higher than the dummy cartridge.

The ink pack is composed of an ink pack unit for storing the ink and a spout unit to be attached to the ink pack pedestal. A male connector of a hollow rod shape provided on the ink pack pedestal is inserted through the spout unit, by which the ink pack is attached, and then the ink contained in the ink pack is supplied to an inkjet head through the male connector and the dummy cartridge. When a remaining amount of the ink contained in the ink pack reaches a predetermined threshold amount or below, a user detaches the ink pack from the mail connector, and attaches a new ink pack to the male connector replacing the old one.

SUMMARY OF THE INVENTION

According to one aspect of the present invention, a bulk ink supply system of an inkjet printer includes a connector, an ink flow path, and an on-off valve. The connector is attachable to and detachable from an ink container. The connector includes an ink guiding path formed in the connector. The ink flow path connects the ink guiding path and an inkjet head of the inkjet printer to supply an ink from the ink guiding path to the inkjet head. The on-off valve allows communication between the ink guiding path and the ink flow path when the ink container is attached to the connector and hinders communication between the ink guiding path and the ink flow path when the ink container is detached from the connector.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
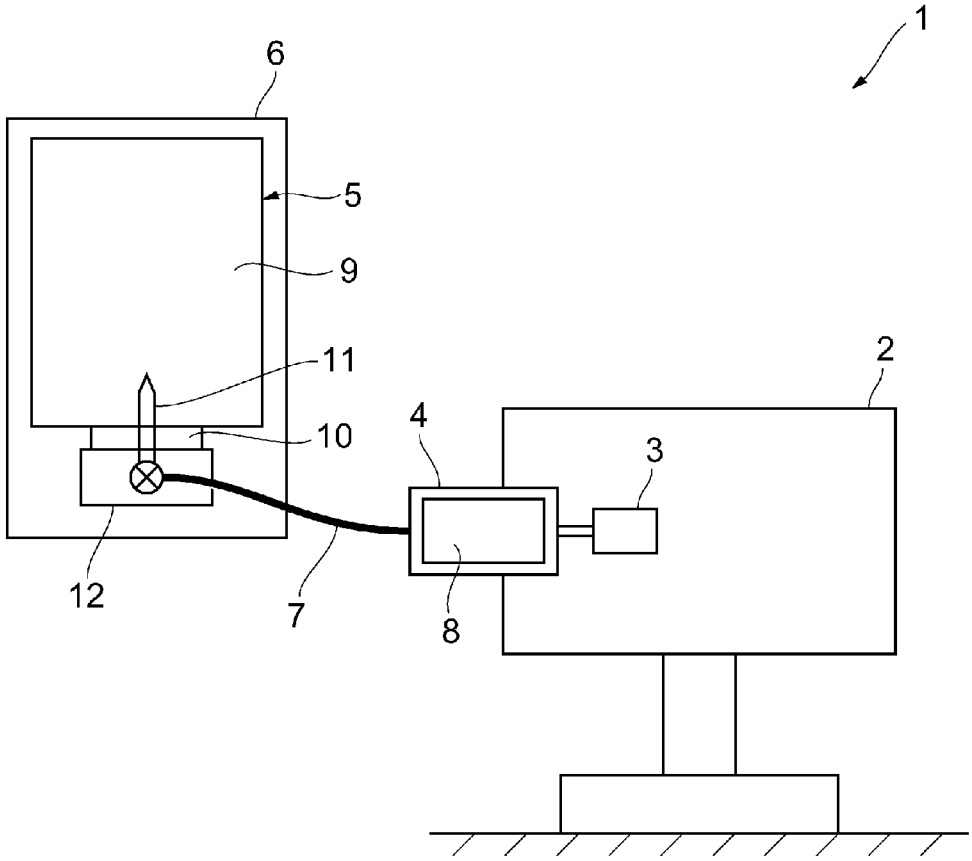
FIG. 1 is a schematic block diagram of a bulk ink supply system according to an embodiment.

The embodiments of the present invention are explained in detail below with reference to accompanying drawings. In the drawings, the same or equivalent parts are assigned with the same reference numeral.

First Embodiment

FIG. 1 is a schematic block diagram of a bulk ink supply system according to an embodiment. As shown in FIG. 1, the bulk ink supply system 1 is an ink supply system that supplies ink to an inkjet printer 2 that prints an image and the like on a medium by discharging the ink on the medium. The bulk ink supply system 1 includes an intermediate cartridge 4 that is attached to the inkjet printer 2 in a detachable manner, an ink pack pedestal 6 to which an ink pack 5 in which the ink is contained is attached in a detachable manner, and an ink tube 7 that connects the intermediate cartridge 4 and the ink pack pedestal 6.

The intermediate cartridge 4 is connected to an inkjet head 3 that is mounted on the inkjet printer 2. The intermediate cartridge 4 includes an intermediate ink pack 8. The intermediate cartridge 4 temporarily stores the ink supplied from the ink pack 5 via the ink tube 7 in the intermediate ink pack 8, and supplies the ink to the inkjet head 3 while adjusting an ink pressure. The ink tube 7 is formed in a tubular shape with an elastic member such as rubber and resin.

The ink pack 5 is a pack for storing a large amount of ink to supply the ink to the inkjet printer 2. The ink pack 5 includes an ink pack unit 9 in which the ink is stored and a spout unit 10.

The ink pack unit 9 is a package type container that contains the ink of an amount as much as 1 liter or 2 liters. The ink pack unit 9 has a hermetically sealed structure by which the ink contained inside is shielded from the outside. Therefore, the ink contained in the ink pack unit 9 is not directly exposed to the outside air, so that a change of properties of the ink does not occur. Furthermore, the ink pack unit 9 is made from a flexible material such as polyvinyl chloride or aluminum, so that its shape can automatically change according to a remaining amount of the ink contained therein.

The spout unit 10 is a base of the ink pack unit 9 that discharges the ink contained in the ink pack unit 9 while sealing the ink pack unit 9. The spout unit 10 is made from an elastic material such as rubber or resin. A male type connector 11 that will be described later is inserted into the spout unit 10. When the ink pack 5 is not attached to the ink pack pedestal 6, the spout unit 10 seals the ink pack unit 9, and when the ink pack 5 is attached to the ink pack pedestal 6, the male type connector 11 that will be described later is inserted into the spout unit 10, by which the ink contained in the ink pack unit 9 is supplied to the inkjet head 3 through the male type connector 11 and the ink tube 7.

The ink pack pedestal 6 is located at a position higher than a position of the intermediate cartridge 4 attached to the inkjet printer 2. Therefore, the ink contained in the ink pack 5 is supplied to the intermediate cartridge 4 by gravity. In order to supply the ink to the ink tube 7 from the ink pack 5, the ink pack pedestal 6 includes the male type connector 11 and an automatic on-off valve 12.

Figure 2:
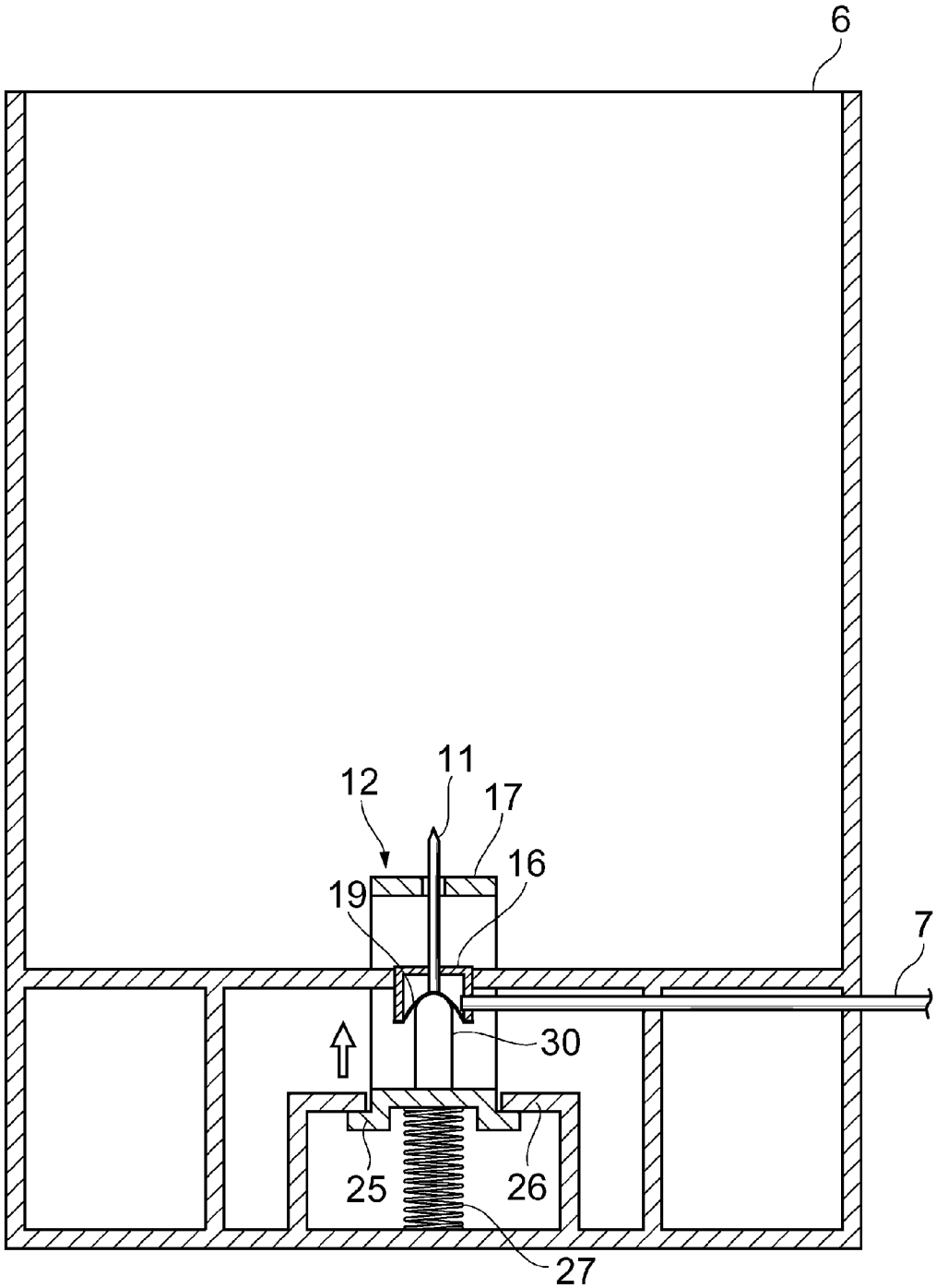
FIG. 2 is a schematic diagram of an ink pack pedestal with an ink pack detached.
Figure 3:
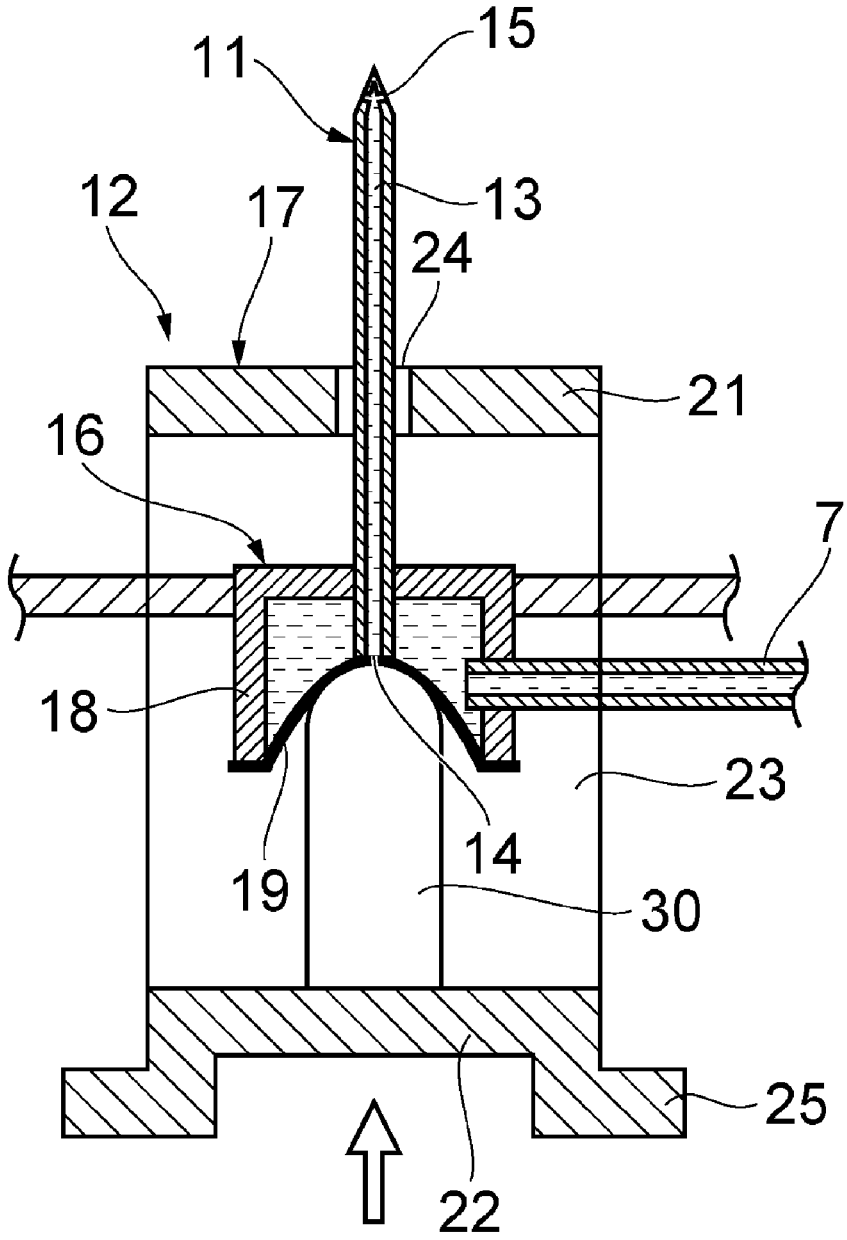
FIG. 3 is a partial cross section of the ink pack pedestal viewed from a front shown in FIG. 2.
Figure 4:
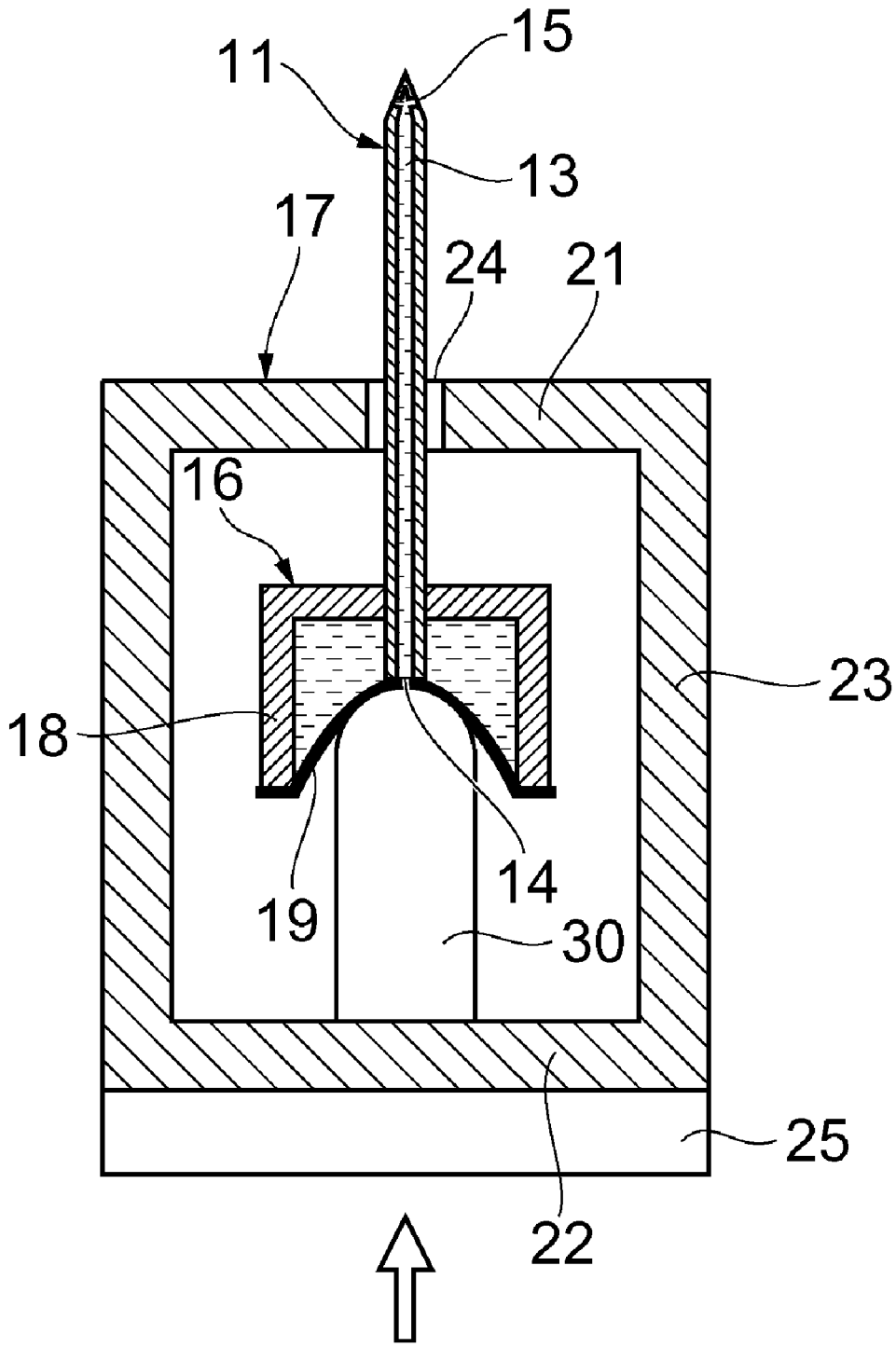
FIG. 4 is a partial cross section of the ink pack pedestal viewed from a side shown in FIG. 2.
Figure 5:
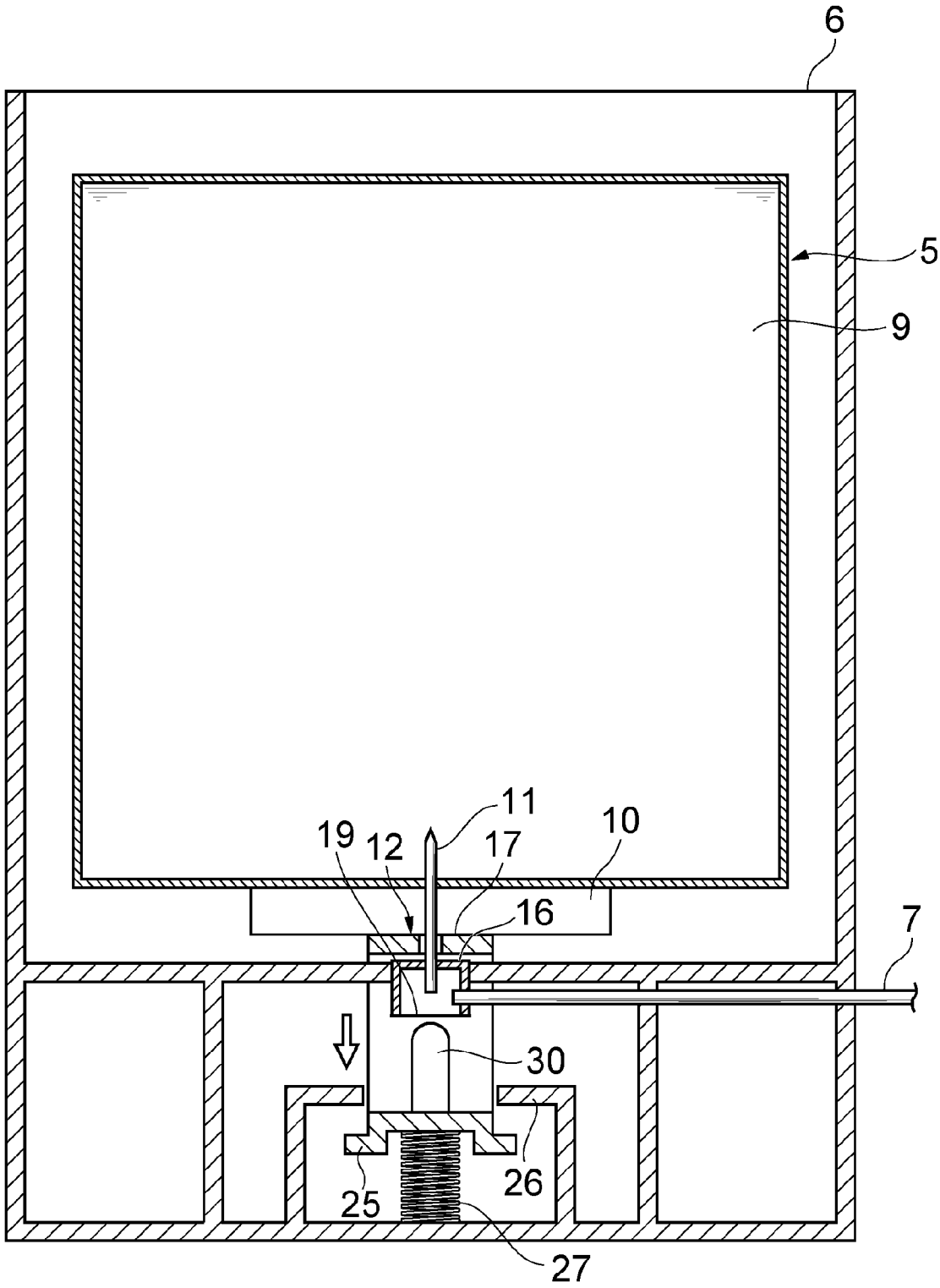
FIG. 5 is a schematic diagram of the ink pack pedestal with an ink pack attached.
Figure 6:
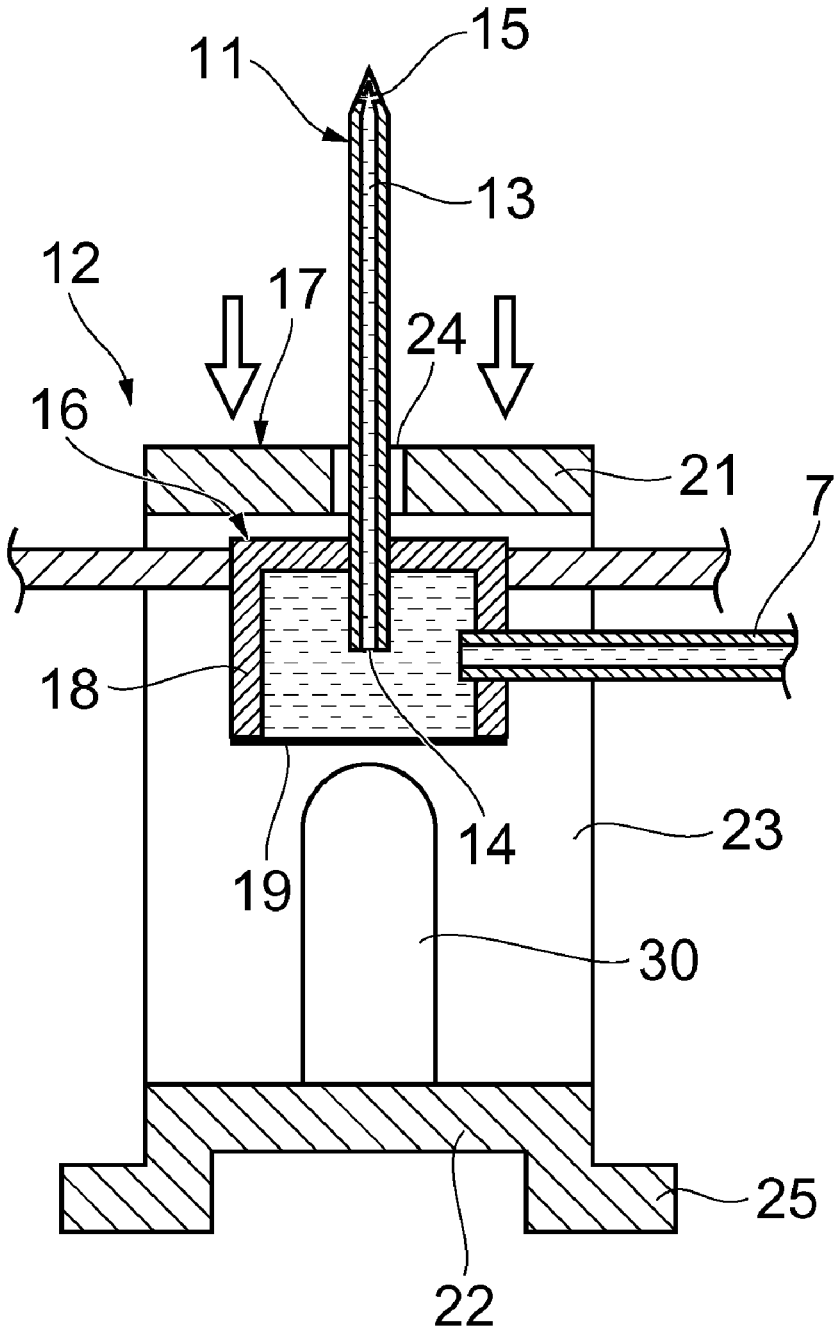
FIG. 6 is a partial cross section of the ink pack pedestal viewed from a front shown in FIG. 5.
Figure 7:
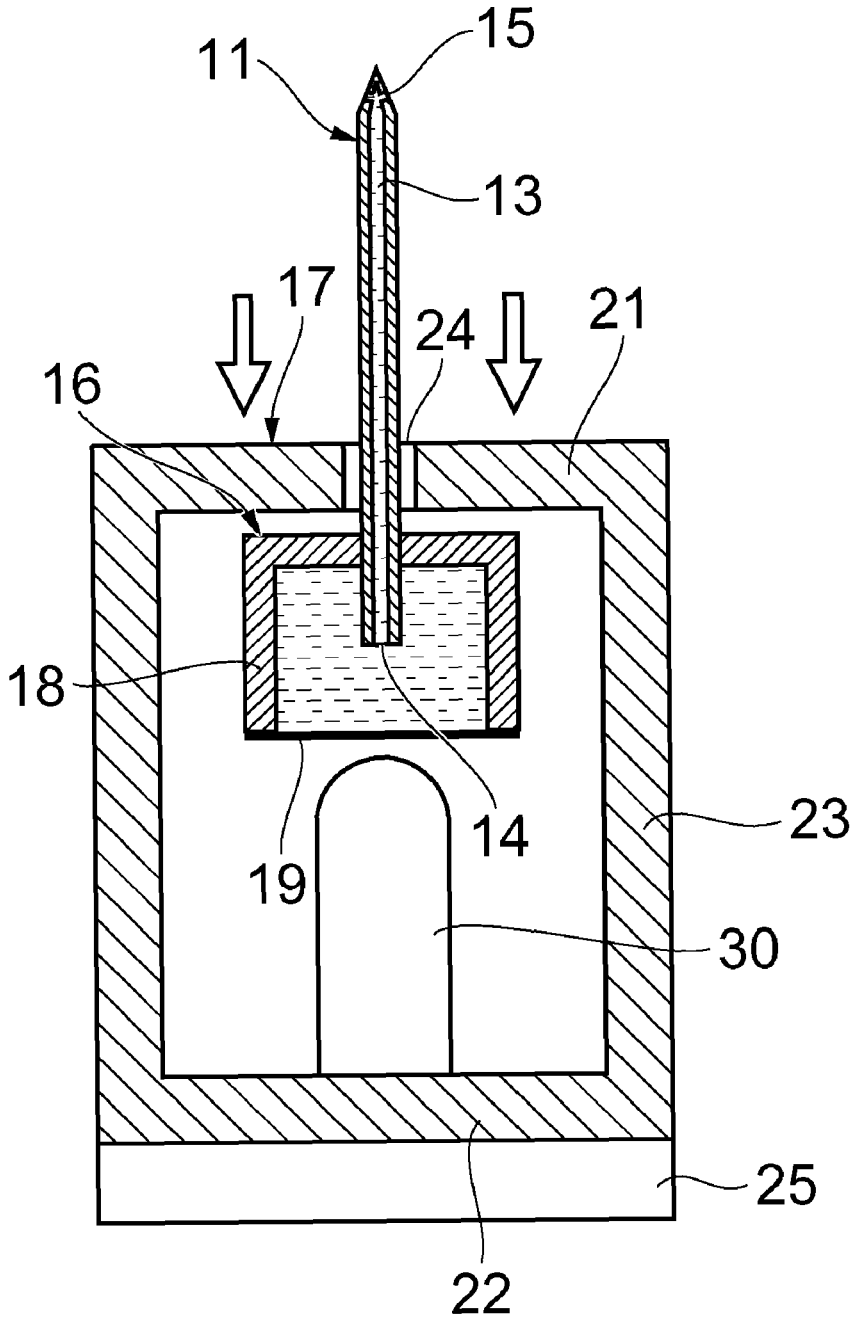
FIG. 7 is a partial cross section of the ink pack pedestal viewed from a side shown in FIG. 5.

FIG. 2 is a schematic diagram of the ink pack pedestal with the ink pack detached, FIG. 3 is a partial cross section of the ink pack pedestal viewed from a front shown in FIG. 2, FIG. 4 is a partial cross section of the ink pack pedestal viewed from a side shown in FIG. 2, FIG. 5 is a schematic diagram of the ink pack pedestal with the ink pack attached, FIG. 6 is a partial cross section of the ink pack pedestal viewed from a front shown in FIG. 5, and FIG. 7 is a partial cross section of the ink pack pedestal viewed from a side shown in FIG. 5.

As shown in FIGS. 2 to 7, the male type connector 11 is rod-shaped and arranged standing in an upward direction. An ink guiding path 13 is formed inside the male type connector 11. The ink guiding path 13 is formed in an elongated hole shape passing through a center axis of the male type connector 11 in the upward direction from an opening portion 14 that is formed at a bottom edge of the male type connector 11. A hole portion 15 for guiding the ink from the ink pack 5 to the ink guiding path 13 is formed at a top portion of the male type connector 11. Therefore, when the male type connector 11 is inserted into the spout unit 10 of the ink pack 5, the ink contained in the ink pack unit 9 is guided from the hole portion 15 of the male type connector 11 to the ink guiding path 13.

The automatic on-off valve 12 is a valve for opening and closing a flow path of the ink guided to the male type connector 11. The automatic on-off valve 12 includes an on-off valve unit 16 and an ink pack detecting unit 17.

The on-off valve unit 16 is an opening and closing valve including a diaphragm type valve. The on-off valve unit 16 includes a box-shaped ink room 18 with a bottom surface opened and a diaphragm valve 19 attached to the bottom surface of the ink room 18.

The ink room 18 forms an ink flow path through which the ink guided to the male type connector 11 flows in and the ink is then flown out to the ink tube 7. Therefore, the male type connector 11 is fixed to the ink room 18 in a penetrating manner from the upward direction, and the ink tube 7 is fixed to the ink room 18 in a penetrating manner in a lateral direction. The ink room 18 is fixed to a frame of the ink pack pedestal 6. Therefore, positions of the ink room 18 and the male type connector 11 that is fixed to the ink room 18 in a penetrating manner are unchanged regardless that the ink pack 5 is attached or detached.

The diaphragm valve 19 is a thin film that separates inside and outside of the ink room 18. The diaphragm valve 19 is made from an elastic material such as rubber or resin, and it can elastically deform in the upward and downward direction. When the diaphragm valve 19 is pressed from the bottom by a protruding unit 30 that will be described later, the diaphragm valve 19 is pushed into the ink room 18 to make an elastic deformation in a convex shape toward the male type connector 11 in the upward direction, by which the opening portion 14 of the male type connector 11 is blocked. On the other hand, when the pressing of the protruding unit 30 is released, the diaphragm valve 19 is restored to a flat shape, by which the opening portion 14 of the male type connector 11 is opened.

The ink pack detecting unit 17 is held in a movable manner in the upward and downward direction with respect to the on-off valve unit 16, being configured in a square-shaped frame body in a cross-sectional view that surrounds the on-off valve unit 16. That is, the ink pack detecting unit 17 includes a ceiling portion 21 arranged above a top of the on-off valve unit 16, a bottom portion 22 arranged below a bottom of the on-off valve unit 16, and a pair of side wall portions 23 that connects the ceiling portion 21 and the bottom portion 22. A through hole 24 through which the male type connector 11 fixed to the ink room 18 passes is formed on the ceiling portion 21. A pair of latch portions 25 that protrudes in a lateral direction is formed on the bottom portion 22, and a hook unit 26 of an inverse L shape in a cross-sectional view for latching the latch portions 25 from above when the ink pack detecting unit 17 is moved upward is formed on the frame of the ink pack pedestal 6. The ink pack detecting unit 17 is biased in the upward direction by a compression force of a spring 27 arranged on a bottom surface of the ink pack pedestal 6, so that in a natural state (normal state) in which the ink pack 5 is not attached, the latch portions 25 are maintained in positions of being latched to the hook unit 26.

Furthermore, the protruding unit 30 arranged standing on the bottom portion 22 is fixed to the ink pack detecting unit 17. The protruding unit 30 is a rod-shaped member with a top edge formed in a rounded shape. A length of the protruding unit 30 is set not to have contact with the diaphragm valve 19 when the ink pack detecting unit 17 is moved in the downward direction, and to press the diaphragm valve 19 in the upward direction when the ink pack detecting unit 17 is moved in the upward direction so that the diaphragm valve 19 is pushed inside to block the opening portion 14 of the male type connector 11.

Operations of the automatic on-off valve 12 when the ink pack 5 is attached and detached are explained below.

Firstly, a state in which the ink pack 5 is attached is explained with reference to FIGS. 5 to 7. As shown in FIGS. 5 to 7, when the ink pack 5 is attached to the ink pack pedestal 6 by inserting the male type connector 11 into the spout unit 10 of the ink pack 5, a distal end portion of the male type connector 11 reaches inside the ink pack unit 9, and the ink contained in the ink pack unit 9 is guided from the hole portion 15 to the ink guiding path 13.

At this time, the ink pack detecting unit 17 of the automatic on-off valve 12 is pressed in the downward direction by the spout unit 10 with the operation of attaching the ink pack 5. Because the protruding unit 30 entered in the ink room 18 is moved in the downward direction, the diaphragm valve 19 is restored to the flat shape by its own restoring force, by which the opening portion 14 of the male type connector 11 is opened. As a result, the male type connector 11 and the ink tube 7 are connected to each other through the ink room 18, and therefore, the ink guided from the ink pack 5 to the male type connector 11 is sent to the ink tube 7. The ink is then supplied to the intermediate ink pack 8 of the intermediate cartridge 4, and then supplied to the inkjet head 3.

An operation of detaching the ink pack 5 is explained below with reference to FIGS. 2 to 4. As shown in FIGS. 2 to 4, when the male type connector 11 is pulled out of the spout unit 10 of the ink pack 5 so that the ink pack 5 is detached from the ink pack pedestal 6, a guide of the ink to the ink pack unit 9 is stopped because the distal end portion of the male type connector 11 is pulled out of the ink pack unit 9.

At this time, the ink pack detecting unit 17 is released from a pressing force of the spout unit 10 with the operation of detaching the ink pack 5. The ink pack detecting unit 17 is then lifted up by the compression force of the spring 27, and the latch portions 25 are moved to the positions of being latched to the hook unit 26. The protruding unit 30 that is lifted toward the ink pack detecting unit 17 enters into the ink room 18 by pushing the diaphragm valve 19 in the upward direction, and blocks the opening portion 14 of the male type connector 11 with the diaphragm valve 19. As a result, because the male type connector 11 and the ink tube 7 are disconnected from each other in the ink room 18, the ink guided to the male type connector 11 is filled in the ink guiding path 13 of the male type connector 11, so that an inflow of the air into the ink guiding path 13 is prevented. At the same time, even when a backflow pressure is exerted on the male type connector 11 from the intermediate ink pack 8, because the ink flow path is blocked in the ink room 18, an overflow of the ink from the male type connector 11 due to the backflow of the ink is prevented.

Second Embodiment

A second embodiment is explained below with reference to FIGS. 8 and 9. A bulk ink supply system 101 according to the second embodiment is basically the same as the bulk ink supply system 1 according to the first embodiment except that the configuration and the operation of the automatic on-off valve differ from those of the bulk ink supply system 1. Therefore, an explanation of the same parts as the first embodiment will be omitted from the following description, and a portion that differs from the first embodiment will be explained only.

Figure 8:
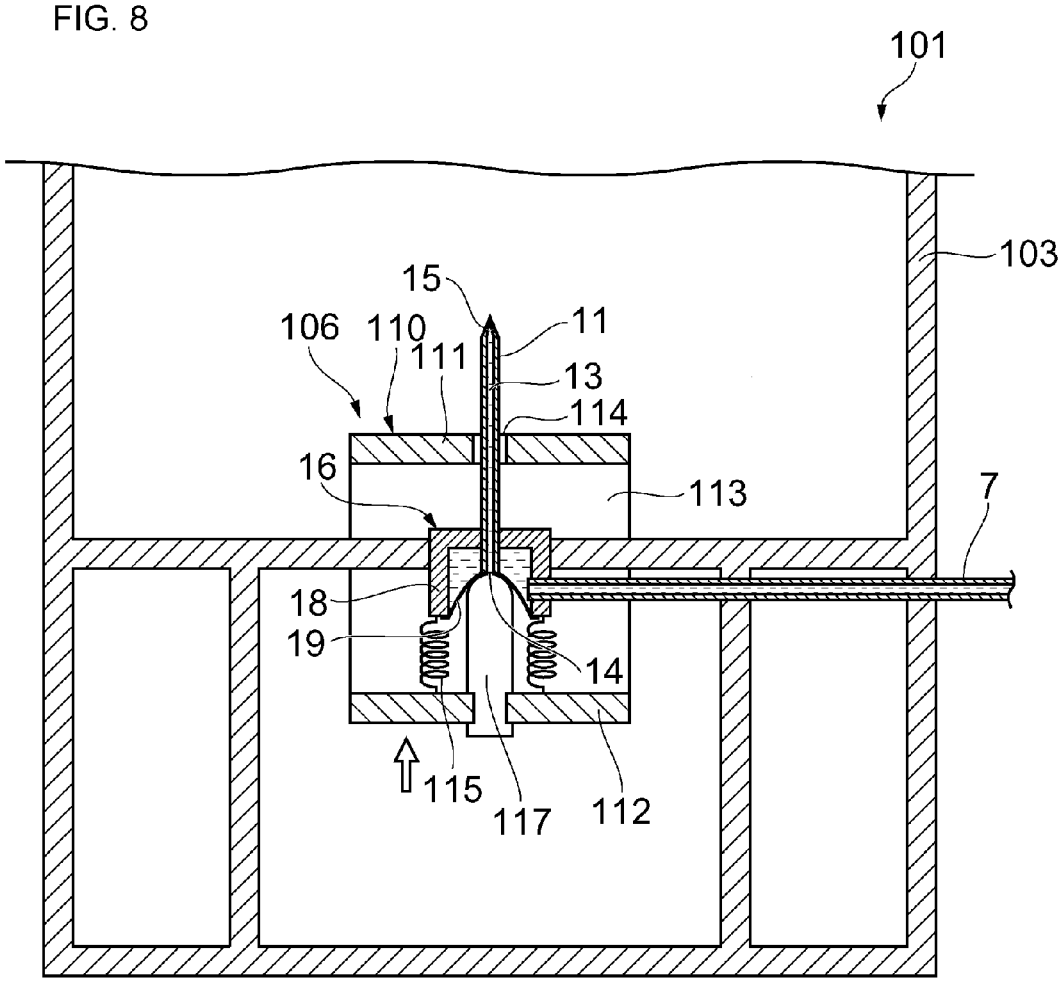
FIG. 8 is a schematic block diagram of an ink pack pedestal with an ink pack detached in a bulk ink supply system according to a second embodiment.
Figure 9:
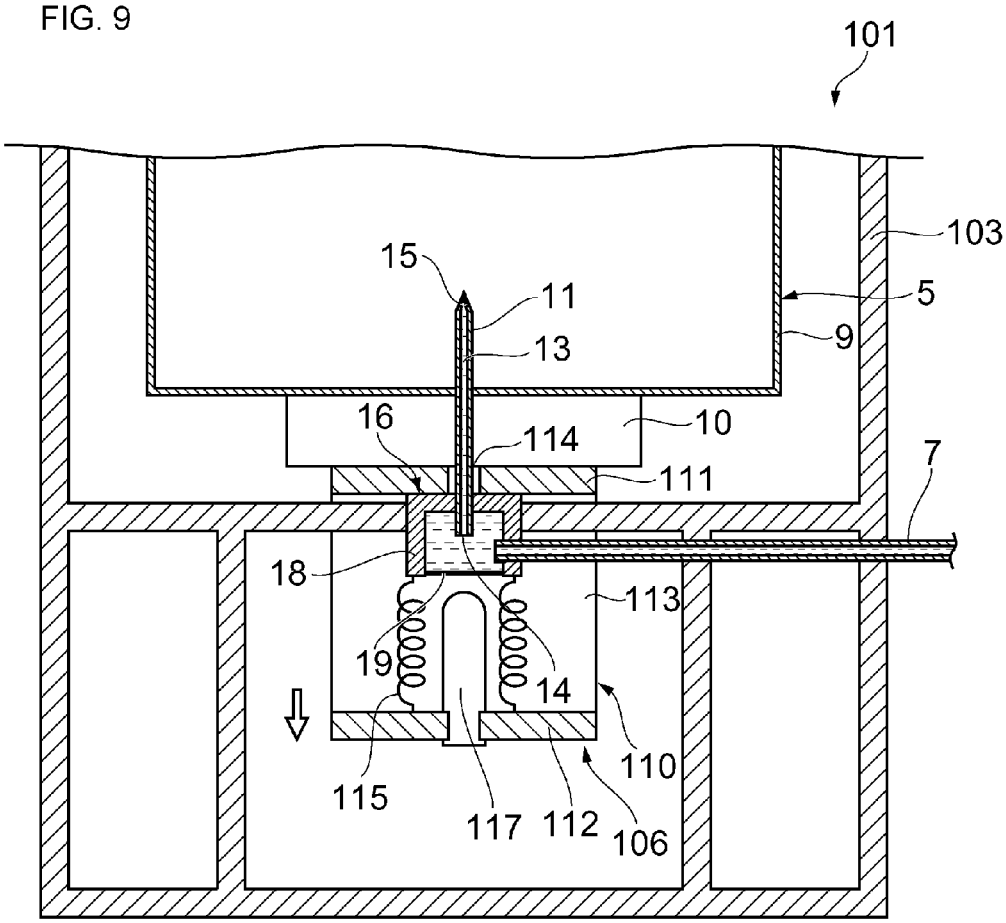
FIG. 9 is a schematic block diagram of the ink pack pedestal with an ink pack attached in the bulk ink supply system according to the second embodiment.

FIG. 8 is a schematic block diagram of an ink pack pedestal with an ink pack detached in the bulk ink supply system according to the second embodiment, and FIG. 9 is a schematic block diagram of the ink pack pedestal with an ink pack attached in the bulk ink supply system according to the second embodiment.

As shown in FIGS. 8 and 9, the bulk ink supply system 101 includes an ink pack pedestal 103 instead of the ink pack pedestal 6 of the bulk ink supply system 1 according to the first embodiment.

The ink pack pedestal 103 is located at a position higher than a position of an intermediate cartridge 4 attached to an inkjet printer 2 such that the ink contained in an ink pack 5 is supplied to the intermediate cartridge 4 by gravity. In order to supply the ink to an ink tube 7 from the ink pack 5, the ink pack pedestal 103 includes a male type connector 11 and an automatic on-off valve 106.

The automatic on-off valve 106 is a valve for opening and closing a flow path of the ink guided to the male type connector 11. The automatic on-off valve 106 includes an on-off valve unit 16 and an ink pack detecting unit 110.

The on-off valve unit 16 is an opening and closing valve including a diaphragm type valve in the same manner as the first embodiment. The on-off valve unit 16 includes a box-shaped ink room 18 with a bottom surface opened and a diaphragm valve 19 attached to the bottom surface of the ink room 18.

The ink pack detecting unit 110 is held in a movable manner in the upward and downward direction with respect to the on-off valve unit 16, being configured in a square-shaped frame body in a cross-sectional view that surrounds the on-off valve unit 16. That is, the ink pack detecting unit 110 includes a ceiling portion 111 arranged above a top of the on-off valve unit 16, a bottom portion 112 arranged below a bottom of the on-off valve unit 16, and a pair of side wall portions 113 that connects the ceiling portion 111 and the bottom portion 112. A through hole 114 through which the male type connector 11 fixed to the ink room 18 passes is formed on the ceiling portion 111. The bottom portion 112 is connected to a tension spring 115 that is connected to the ink room 18 (or a frame of the ink pack pedestal 103). The ink pack detecting unit 110 is biased in the upward direction by a tension of the tension spring 115.

Furthermore, a protruding unit 117 extending in the upward direction is fixed to the ink pack detecting unit 110 in a fitted manner. The protruding unit 117 is a rod-shaped member with a top edge formed in a rounded shape. A length of the protruding unit 117 is set not to have contact with the diaphragm valve 19 when the ink pack detecting unit 110 is moved in the downward direction, and to press the diaphragm valve 19 in the upward direction when the ink pack detecting unit 110 is moved in the upward direction so that the diaphragm valve 19 is pushed inside to block an opening portion 14 of the male type connector 11.

Operations of the automatic on-off valve 106 when the ink pack 5 is attached and detached are explained below.

Firstly, a state in which the ink pack 5 is attached is explained with reference to FIG. 9. As shown in FIG. 9, when the ink pack 5 is attached to the ink pack pedestal 103 by inserting the male type connector 11 into a spout unit 10 of the ink pack 5, a distal end portion of the male type connector 11 reaches inside an ink pack unit 9, and the ink contained in the ink pack unit 9 is guided from the hole portion 15 to an ink guiding path 13.

At this time, the ink pack detecting unit 110 of the automatic on-off valve 106 is pressed by the spout unit 10 in the downward direction with the operation of attaching the ink pack 5. Because the protruding unit 117 entered in the ink room 18 is moved in the downward direction, the diaphragm valve 19 is restored to the flat shape by its own restoring force, by which the opening portion 14 of the male type connector 11 is opened. As a result, the male type connector 11 and the ink tube 7 are connected to each other through the ink room 18, and therefore, the ink guided from the ink pack 5 to the male type connector 11 is sent to the ink tube 7. The ink is then supplied to an intermediate ink pack 8 of the intermediate cartridge 4, and then supplied to an inkjet head 3.

An operation when the ink pack 5 is detached is explained below with reference to FIG. 8. As shown in FIG. 8, when the male type connector 11 is pulled out of the spout unit 10 of the ink pack 5 so that the ink pack 5 is detached from the ink pack pedestal 103, a guide of the ink to the male type connector 11 is stopped because the distal end portion of the male type connector 11 is pulled out of the ink pack unit 9.

At this time, the ink pack detecting unit 110 is released from a pressing force of the spout unit 10 with the operation of detaching the ink pack 5. The ink pack detecting unit 110 is then lifted up by the tension of the tension spring 115. The protruding unit 117 that is lifted toward the ink pack detecting unit 110 enters into the ink room 18 by pushing the diaphragm valve 19 in the upward direction, and blocks the opening portion 14 of the male type connector 11 with the diaphragm valve 19. As a result, because the male type connector 11 and the ink tube 7 are disconnected from each other in the ink room 18, the ink guided to the male type connector 11 is filled in the ink guiding path 13 of the male type connector 11, so that an inflow of the air into the ink guiding path 13 is prevented. At the same time, even when a backflow pressure is exerted on the male type connector 11 from the intermediate ink pack 8, because the ink flow path is blocked in the ink room 18, an overflow of the ink from the male type connector 11 due to the backflow of the ink is prevented.

In this manner, with the bulk ink supply systems 1 and 101 according to the present embodiments, when the ink pack 5 is attached to the male type connector 11, the ink flow path is opened by the automatic on-off valve 12, and the ink pack 5 and the inkjet head 3 are connected to each other through the ink tube 7, by which the ink is supplied to the inkjet head 3, and when the ink pack 5 is detached from the male type connector 11, the ink flow path is closed by the automatic on-off valve 12, and the supply of the ink to the inkjet head 3 is stopped. With this configuration, because the inflow of the air into the ink tube 7 from the male type connector 11 can be prevented, it is possible to prevent a failure of an ink ejection due to the air flown into the ink tube 7 or the inkjet head 3. Furthermore, even when a pressure is exerted on the ink from the inkjet head 3 side to the male type connector 11 side, such as when the intermediate ink pack 8 provided between the ink pack 5 and the inkjet head 3 is sufficiently swollen, because the automatic on-off valve 12 closes the ink flow path when the ink pack 5 is detached from the male type connector 11, it is possible to prevent the ink from flowing backward in the ink flow path and overflowing from the male type connector 11.

Furthermore, with the bulk ink supply systems 1 and 101 according to the present embodiments, when the ink pack 5 is attached or detached to or from the male type connector 11, the ink flow path is opened or closed by the protruding units 30 and 117 deforming the diaphragm valve 19 in conjunction with the attachment or detachment of the ink pack 5. That is, when the ink pack 5 is attached to the male type connector 11, the protruding units 30 and 117 deform the diaphragm valve 19, by which the ink flow path is opened, and when the ink pack 5 is detached from the male type connector 11, the protruding units 30 and 117 deform the diaphragm valve 19, by which the ink flow path is closed. With this configuration, it is possible to prevent the air from flowing into the ink tube 7 from the male type connector 11, and at the same time, it is possible to prevent a backflow of the ink when the ink pack 5 is removed from the male type connector 11.

Specifically, when the ink pack 5 is attached to the male type connector 11, because the ink pack detecting unit 17 and 110 are pressed by the spout unit 10 of the ink pack 5 and moved to the direction of attaching the ink pack 5, the pressing of the diaphragm valve 19 by the protruding units 30 and 117 is released, by which the opening portion 14 of the male type connector 11 is opened so that the ink flow path is opened. On the other hand, when the ink pack 5 is detached from the male type connector 11, because the protruding units 30 and 117 are moved to the direction of detaching the ink pack 5 by the biasing force of the spring 27 or the tension spring 115, the diaphragm valve 19 is pressed by the protruding units 30 and 117, by which the opening portion 14 of the male type connector 11 is closed so that the ink flow path is closed. In this manner, because the opening and closing of the ink flow path can be performed by a mechanical operation in conjunction with the attachment and detachment of the ink pack 5, it is possible to perform the opening and closing of the ink flow path for sure without being affected by an electrical failure or the like.

Although the embodiments of the present invention were explained so far, the present invention is not limited to the above embodiments. For example, although the explanation was given with an example in which the protruding units 30 and 117 are completely pulled out of the ink room 18 when the ink pack 5 is detached from the male type connector 11, a part of the protruding units 30 and 117 can be remained being inserted into the ink room 18 so that the diaphragm valve 19 is pressed by the protruding units 30 and 117 as long as it is possible to open the opening portion 14 of the male type connector 11 by the diaphragm valve 19.

Furthermore, although the explanation was given using the rod-shaped male type connector 11 as the connector for guiding the ink from the ink pack 5 in the above embodiments, the connector can have any shape and structure as long as it can guide the ink from the ink pack 5. In addition, although the spout unit 10 of the ink pack 5 was explained to guide the ink by being inserted with the male type connector 11, the spout unit 10 can have any shape and structure, such as a rubber seal structure and the like, as long as the ink is not leaked from the spout unit 10 when attaching and detaching the male type connector 11.

Furthermore, although the explanation was given such that the opening and closing of the ink flow path is performed by the mechanical operation of deforming the diaphragm valve 19 by the movements of the ink pack detecting unit 17 and 110 in conjunction with the attachment and detachment of the ink pack 5, the opening and closing of the ink flow path can also be performed using an electric or optical means. In this case, for example, it suffices to have a configuration including an ink pack detecting sensor that detects an existence of the ink pack 5 in an electrical or optical manner and a driving unit that deforms the diaphragm valve 19 by moving a protruding unit or the like. When the ink pack detecting sensor detects an attachment of the ink pack 5, the driving unit moves the protruding unit to open the ink flow path by the diaphragm valve, and when the ink pack detecting sensor detects a detachment of the ink pack 5, the driving unit moves the protruding unit to close the ink flow path by the diaphragm valve.

In addition, the attachment and detachment state of the ink pack 5 can be displayed on a display device such as an LED based on a detection result of the ink pack detecting sensor, and a remaining amount detecting sensor that detects a remaining amount of the ink contained in the ink pack 5 can be provided so that the remaining amount of the ink can be displayed on a display device such as an LED based on a detection result of the remaining amount detecting sensor. The information on the attachment and detachment state of the ink pack 5 or the remaining amount of the ink can be notified to the inkjet printer 2 or a personal computer by an electrical means or the like.

With the bulk ink supply system according to the embodiment of the present invention, because the on-off valve opens or closes the ink flow path in conjunction with attachment or detachment of the ink containing unit to or from the connector, it is possible to prevent the air from flowing into the ink flow path from the connector when attaching and detaching the ink containing unit, and as a result, it is possible to prevent a failure of an ink ejection due to the air flown into the ink flow path or the inkjet head. Furthermore, even when a pressure is exerted on the ink from the inkjet head side to the connector side, such as when an intermediate ink pack provided between the ink containing unit and the inkjet head is sufficiently swollen, because the on-off valve opens or closes the ink flow path in conjunction with the attachment or detachment of the ink containing unit, it is possible to prevent the ink from flowing backward in the ink flow path and overflowing from the connector.

With this bulk ink supply system according to the embodiment of the present invention, the on-off valve opens the ink flow path when the ink containing unit is attached to the connector so that the ink containing unit and the inkjet head is connected to each other through the ink flow path to supply the ink to the inkjet head, and the on-off valve closes the ink flow path when the ink containing unit is detached from the connector so that a supply of the ink to the inkjet head is stopped. With this configuration, it is possible to prevent the air from flowing into the ink flow path from the connector, and as a result, it is possible to prevent a failure of the ink ejection due to the air flown into the ink flow path or the inkjet head. Furthermore, even when a pressure is exerted on the ink from the inkjet head side to the connector side, such as when the intermediate ink pack provided between the ink containing unit and the inkjet head is sufficiently swollen, because the on-off valve closes the ink flow path when the ink containing unit is detached from the connector, it is possible to prevent the ink from flowing backward in the ink flow path and overflowing from the connector.

With this bulk ink supply system according to the embodiment of the present invention, when the ink containing unit is attached or detached to or from the connector, the ink flow path is opened or closed by the pressing member deforming a diaphragm member in conjunction with the attachment or detachment of the ink containing unit. That is, when the ink containing unit is attached to the connector, the pressing member deforms the membrane member, by which the ink flow path is opened, and when the ink containing unit is detached from the connector, the pressing member deforms the membrane member, by which the ink flow path is closed. With this configuration, it is possible to prevent the air from flowing into the ink flow path from the connector, and at the same time, it is possible to prevent a backflow of the ink when the ink containing unit is removed from the connector.

With this bulk ink supply system according to the embodiment of the present invention, when the ink containing unit is attached to the connector, because the ink-containing-unit attachment detecting unit is pressed by the ink containing unit in a direction of attachment of the ink containing unit, the pressing of the membrane member by the protruding unit is released or reduced, by which the ink flow path is opened. On the other hand, when the ink containing unit is detached from the connector, because the ink-containing-unit attachment detecting unit is moved to a direction of detachment of the ink containing unit by a biasing force from the biasing unit, the membrane member is pressed by the protruding unit, by which the ink flow path is closed. In this manner, because the opening and closing of the ink flow path can be performed by a mechanical operation in conjunction with the attachment and detachment of the ink containing unit, it is possible to perform the opening and closing of the ink flow path for sure without being affected by an electrical failure or the like.

According to the embodiment of the present invention, it is possible to prevent the air from flowing into the ink flow path when replacing the ink pack.

The embodiment of the present invention can be used as a bulk ink supply system of an inkjet printer for supplying ink to an inkjet head from an ink containing unit.

Obviously, numerous modifications and variations of the present invention are possible in light of the above teachings. It is therefore to be understood that within the scope of the appended claims, the invention may be practiced otherwise than as specifically described herein.

The invention claimed is:

1. A bulk ink supply system comprising:

a connector attachable to and detachable from an ink container and including an ink guiding path formed in the connector;

an ink flow path connecting the ink guiding path and an inkjet head of the inkjet printer to supply an ink from the ink guiding path to the inkjet head; and an on-off valve to allow communication between the ink guiding path and the ink flow path when the ink container is attached to the connector and to hinder communication between the ink guiding path and the ink flow path when the ink container is detached from the connector, wherein the on-off valve includes an elastic membrane member, and a pressing member to deform the elastic membrane member to allow or hinder communication between the ink guiding path and the ink flow path, wherein the pressing member includes an ink-container attachment detector capable of contacting with the ink container and movable in a direction where the ink container is attached to or detached from the connector, a pressing device pressing the ink-container attachment detector in a direction where the ink container is detached from the connector, and a protruding member fixed to the ink-container attachment detector, wherein, when the ink container is detached from the connector, the protruding member presses the elastic membrane member using a force applied by the pressing device to hinder communication between the ink guiding path and the ink flow path, and wherein, when the ink container is attached to the connector, the ink-container attachment detector contacts with the ink container and moves in a direction where the ink container is attached to the connector against the force applied by the pressing device, and the protruding member is provided with respect to the elastic membrane member to allow communication between the ink guiding path and the ink flow path.

* * * * *